US011211733B1

(12) United States Patent
Raybold et al.

(10) Patent No.: US 11,211,733 B1
(45) Date of Patent: Dec. 28, 2021

(54) REINFORCED ELECTRICAL TERMINAL

(71) Applicant: TE Connectivity Services GmbH, Schaffhausen (CH)

(72) Inventors: Christopher Ryan Raybold, Elizabethtown, PA (US); Forrest Irving Kinsey, Jr., Harrisburg, PA (US); Ryan David Hetrick, Carlisle, PA (US); John Mark Myer, Millersville, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/903,631

(22) Filed: Jun. 17, 2020

(51) Int. Cl.
*H01R 13/434* (2006.01)
*H01R 13/11* (2006.01)

(52) U.S. Cl.
CPC ..... *H01R 13/434* (2013.01); *H01R 13/11* (2013.01)

(58) Field of Classification Search
None
See application file for complete search history.

(56) References Cited

U.S. PATENT DOCUMENTS

2017/0170589 A1* 6/2017 Kida ..... H01R 13/113

* cited by examiner

*Primary Examiner* — Ross N Gushi

(57) ABSTRACT

An electrical contact a mating portion for mating with a mating contact. The mating portion has a contact portion and a retention portion. The mating portion has a mating portion bottom wall, a mating portion top wall and mating portion side walls. A respective mating portion side wall has an upper portion which extends beyond the top wall. The retention portion has a retention portion top wall, a retention portion side wall and a retention portion back wall. The retention portion back wall is configured to approximate the space provided between the mating portion top wall, the upper portion of the respective mating portion side wall, the retention portion top wall and a retention portion side wall. The retention portion back wall prevents damage or deformation of the retention portion as a force applied to the retention portion.

20 Claims, 4 Drawing Sheets

REINFORCED ELECTRICAL TERMINAL

FIELD OF THE INVENTION

The present invention is directed to an electrical terminal with improved strength. In particular, the invention is directed to a terminal with improved strength to avoid damage when undergoing qualification or assembly into the connector housing.

BACKGROUND OF THE INVENTION

The need for electrical connectors which are compact in size continues to increase. As the connectors are made smaller, the electrical terminals positioned in the connectors must also be made smaller. The miniaturization of the terminals requires that less material be used in the manufacturer of the terminals, thereby making the terminals vulnerable to damage or deformation when in use or when undergoing testing, qualification or assembly into the connector housing.

It would, therefore, be beneficial to provide a terminal with improved strength to prevent damage or deformation. It would also be beneficial to provide such a reinforced terminal without increasing the overall size of the terminal.

SUMMARY OF THE INVENTION

It is another object of the subject invention to provide a one piece connector, thereby eliminating loose components which can fall during installation or which can come loose during operation.

An embodiment is directed to an electrical contact a mating portion for mating with a mating contact. The mating portion has a contact portion and a retention portion. The mating portion has a mating portion bottom wall, a mating portion top wall and mating portion side walls. A respective mating portion side wall has an upper portion which extends beyond the top wall, the upper portion extends to form the retention portion. The retention portion has a retention portion top wall, a retention portion side wall and a retention portion back wall. The retention portion back wall is configured to approximate the space provided between the mating portion top wall, the upper portion of the respective mating portion side wall, the retention portion top wall and a retention portion side wall. The retention portion back wall cooperates with one or more of the mating portion top wall, the upper portion of the respective mating portion side wall, the retention portion top wall and a retention portion side wall to prevent damage or deformation of the retention portion as a force applied to the retention portion.

An embodiment is directed to an electrical contact a mating portion for mating with a mating contact. The mating portion has a contact portion and a retention portion. The mating portion has a mating portion bottom wall, a mating portion top wall and mating portion side walls. A respective mating portion side wall has an upper portion which extends beyond the top wall, the upper portion extends to form the retention portion. A detent receiving opening is provided on the mating portion top wall. The retention portion has a retention portion top wall and a retention portion side wall. A detent is provided on the retention portion side wall and extends from a free end of the retention portion side wall. the detent is positioned in alignment with the detent receiving opening. The detent cooperates with the detent receiving opening to prevent damage or deformation of the retention portion as a force applied to the retention portion.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
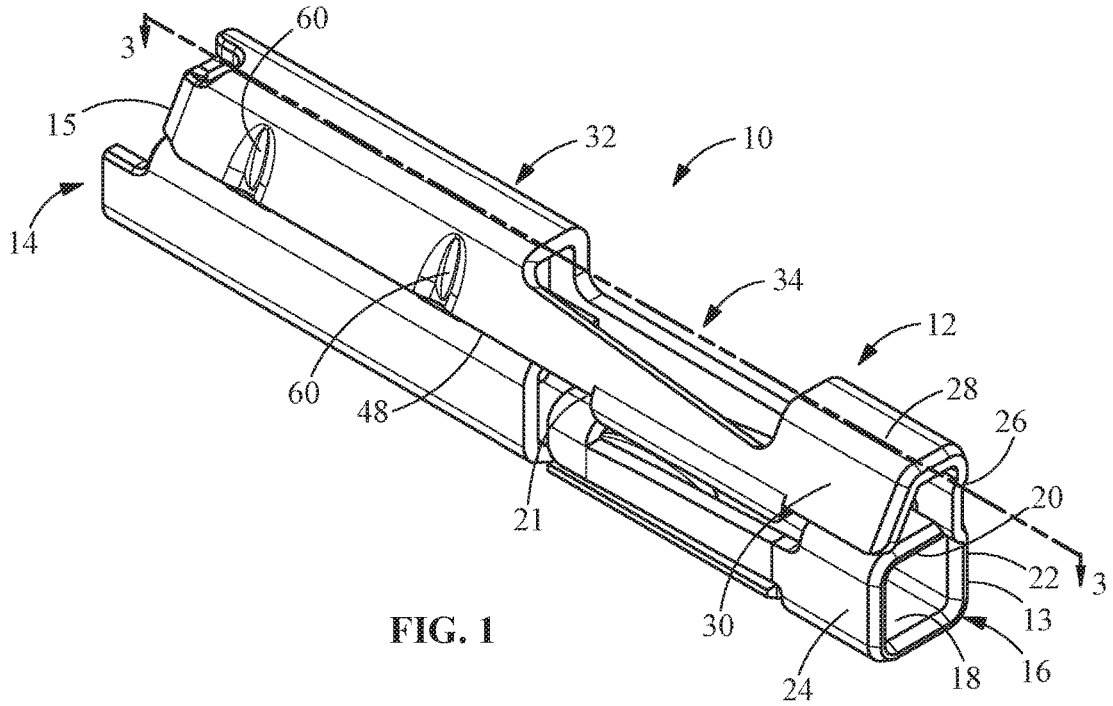
FIG. 1 is a front perspective view of an illustrative embodiment of an electrical terminal according to the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
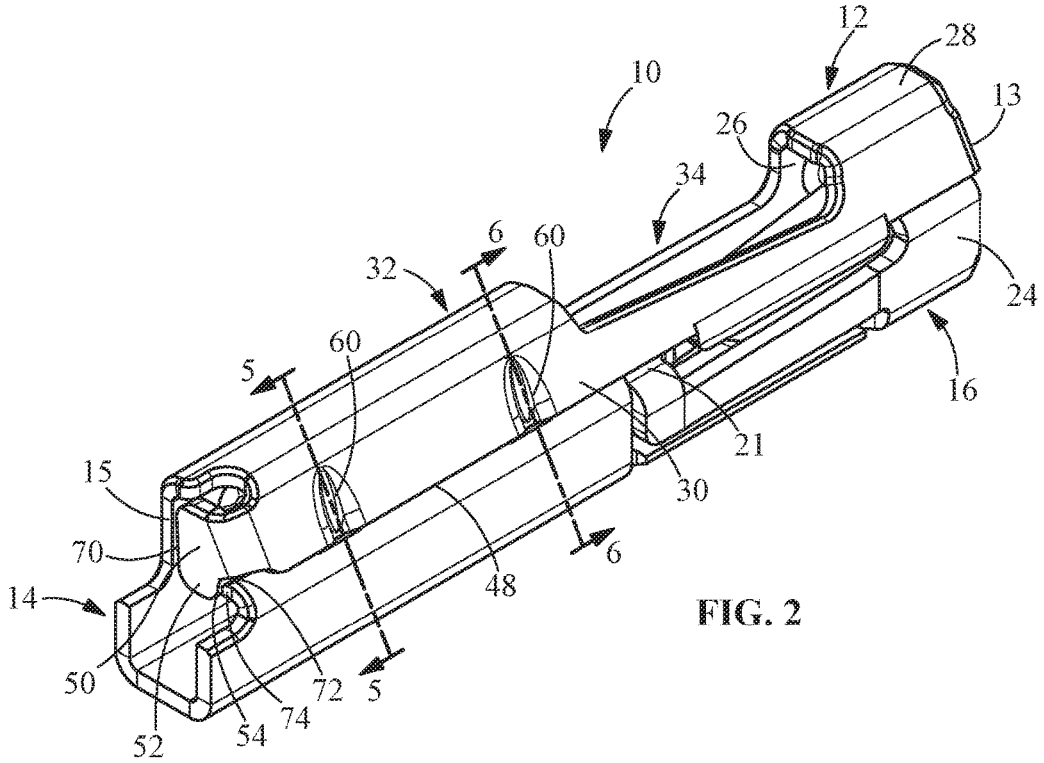
FIG. 2 is a back perspective view of the electrical terminal of FIG. 1.

As shown in the illustrative embodiment of FIGS. 1 and 2, a receptacle contact 10 including a mating portion 12 and a transition portion or region 14. The transition portion 14 extends to a termination portion (not shown), such as, but not limited to a crimp portion. The entire receptacle contact 10 is formed from a single piece stamped sheet-metal form, which is stamped and formed or bent into the configuration shown in FIGS. 1 and 2.

As shown in FIG. 1, the mating portion 12 includes a front or mating contact receiving end 13 and a back end 15 proximate the transition portion 14. The mating portion 12 includes a box-shaped contact portion 16 for accepting a respective mating contact or mating pin contact (not shown). The box-shaped contact portion 16 has a bottom wall 18, a top wall 20 and side walls 22, 24.

A respective side wall 22 has an upper portion 26 which extends beyond the top wall 20. The upper portion 26 of the side wall 22 is formed to provide a top wall 28 and a sloped side wall 30. The upper portion 26 of the side wall 22, the top wall 28 and the sloped side wall 30 form a retention portion 32 of the mating portion 12 of the contact 10. The retention portion 32 extends from the front end 13 to the rear end 15 of the mating portion 12.

As shown in FIGS. 1 and 2, the upper portion 26 of the side wall 22, the top wall 28 and the sloped side wall 30 have a cavity or opening 34 provided therein. The opening 34 is configured to receive a locking projection (not shown) of a connector housing (not shown) into which the contact 10 is inserted. The locking projection is dimensioned to cooperate with the cavity or opening 34 to maintain the receptacle contact 10 in position in the housing. The locking projection cooperates with the receptacle contact 10 to provide the primary retention of the receptacle contact 10 in the housing.

In alternative embodiments, the upper portion 26 of the side wall 22, the top wall 28 or the sloped side wall 30 may have an orientation and/or locking feature or locking projection (not shown) which projects outward therefrom. The locking projection is dimensioned to cooperate with a cavity of a housing (not shown) to maintain the receptacle contact 10 in position in the housing. The locking projection cooperates with the housing to provide the primary retention of the receptacle contact 10 in the housing. The locking projection may also act as a polarizing means. If a housing into which the receptacle contact 10 is to be inserted has a corresponding cavity into which the projection is to be positioned, then it is assured that the receptacle contact 10 cannot be improperly inserted into the housing.

Figure 3:
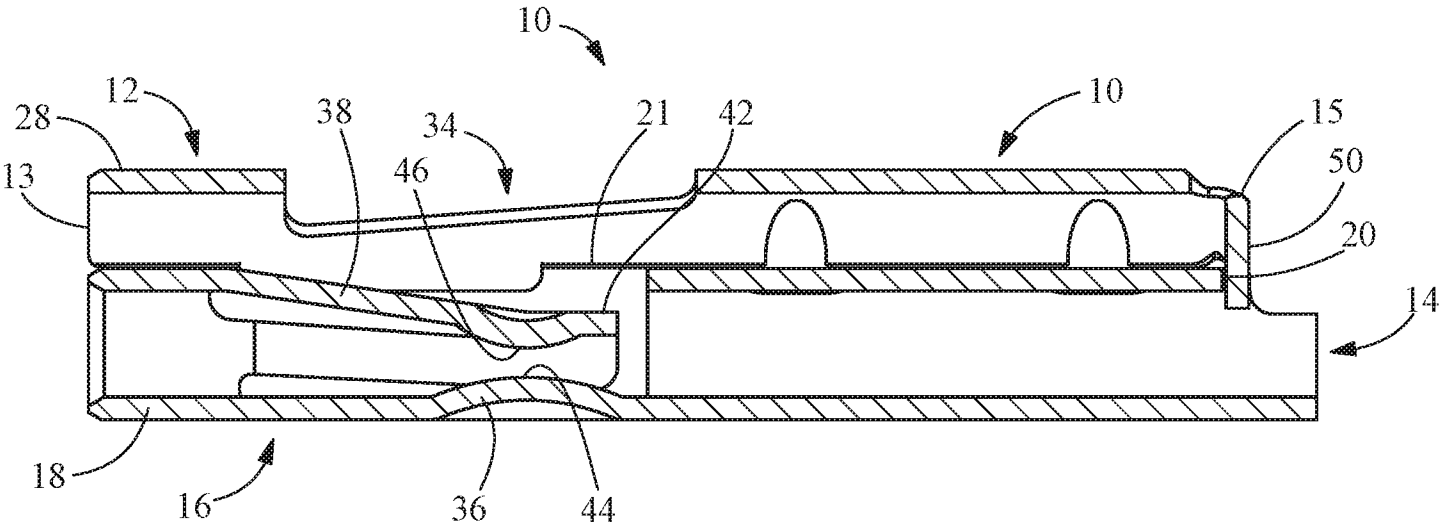
FIG. 3 is a cross-sectional view taken along line 3-3 of FIG. 1.
Figure 6:
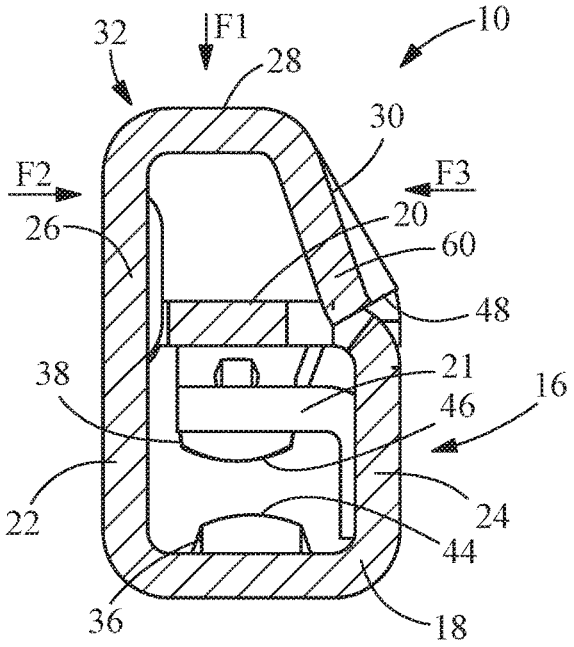
FIG. 6 is a cross-sectional view taken along line 6-6 of FIG. 2.

As shown in FIG. 3, the one-piece receptacle contact 10 has a first resilient contact projection 36 and a second resilient contact projection or spring arm 38, which are formed integrally from the bottom wall 18 and the top wall 20, respectively. Portions of the two resilient contact arms 36, 38 extend toward one another. The resilient contact projections 36, 38 have respective freely movable contact areas 44, 46 (FIGS. 4 and 6) provided proximate thereto. In the embodiment shown, the contact areas 44, 46 are rounded and are laterally offset, but are relatively close together, so that even when small contact pins are inserted, a secure and reliable mechanical and electrical connection is assured. At least in the region of the contact areas 44, 46, the resilient contact projections 36, 38 are preferably provided with a plating or metalizing layer, such as a gold or tin overlay, thereby providing an enhanced electrical connection with the inserted contact pin. An overstress protection portion 21 extends from the side wall 24 (as shown in FIG. 6) to cooperate with a free end 42 the resilient contact arm 38 to prevent the overstress of the contact projection 38. The overstress protection portion 21 extends essentially parallel to the top wall 20.

As shown in FIG. 1, a free end 48 of the sloped side wall 30 is positioned proximate the top wall 20 of the box shaped contact portion 16. The free end 48 may be positioned proximate to or in engagement with the top wall 20 when no forces are applied to the contact 10. If a force is applied to the upper portion 26 of the side wall 22, the top wall 28 or the sloped side wall 30, the retention portion 32 may be compressed or rotated, causing the free end 48 to engage the top wall 20, thereby preventing deformation of the retention portion 32.

Figure 4:
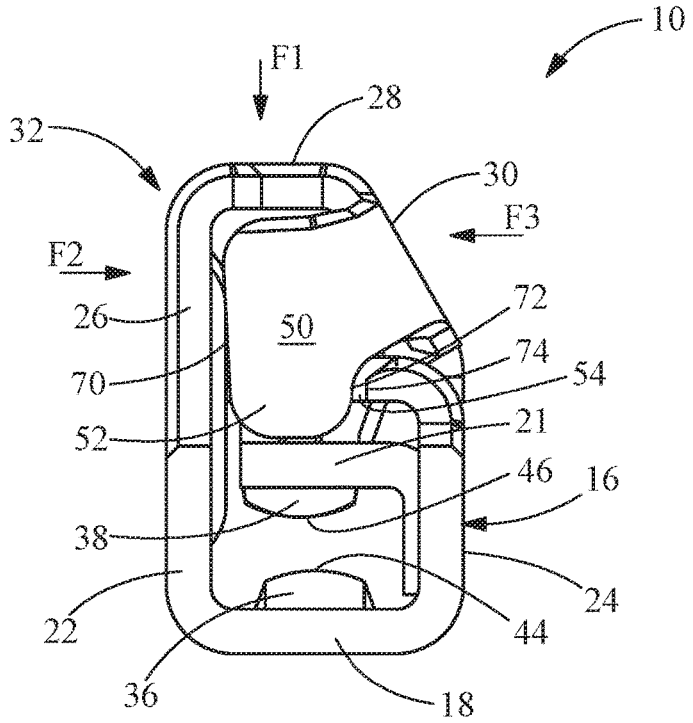
FIG. 4 is back view of the electrical terminal of FIG. 1.

As shown in FIGS. 2 and 4, the retention portion 32 has a back wall 50 which extends from the sloped side wall 30. The back wall 50 extends at approximately 90 degrees from the sloped side wall 30. The back wall 50 is configured to approximate the space provided between the sloped side wall 30, the top wall 20 of the box shaped contact portion 16, the upper portion 26 of the side wall 22, and the top wall 28. A securing portion 52 of the back wall 50 extends into a cavity 54 formed in the top wall 20 of the box shaped contact portion 16 proximate the back end 15. The cavity 54, as shown in FIGS. 2 and 4, is a cutout or opening which extends through the top wall 20 and which is dimensioned to receive and retain the securing portion 52 of the back wall 50 therein.

Figure 5:
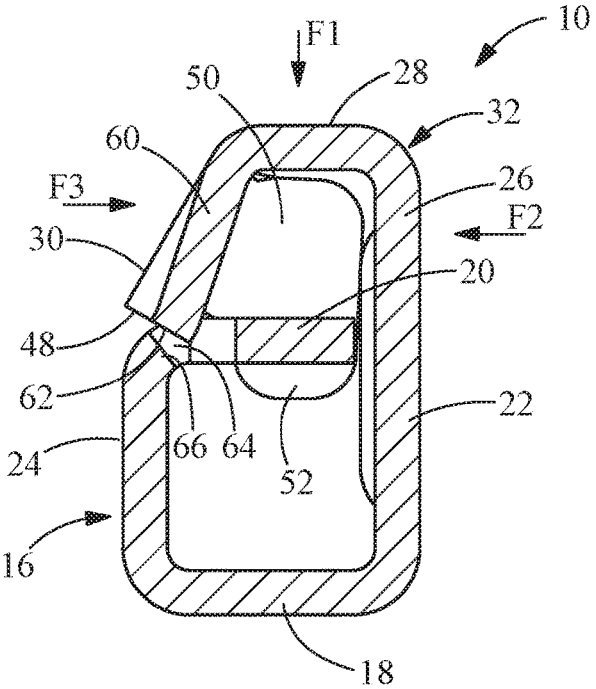
FIG. 5 is a cross-sectional view taken along line 5-5 of FIG. 2.

As shown in FIGS. 1, 2, 5 and 6, the retention portion 32 has detents 60 spaced along the length of the sloped side wall 30. The detents 60 extend from the free end 48 of the sloped side wall 30. In the illustrative embodiment shown, two detents 60 are shown. However, other numbers and configurations of detents may be used. As shown in FIG. 5, the detents 60 have engagement shoulders 62 which are provided proximate the free end 48 of the sloped side wall 30.

As shown in FIG. 5, detent receiving openings 64 are spaced along the length of the top wall 20 of the box shaped contact portion 16. The detent receiving openings 64 are positioned in alignment with the detents 60. In the illustrative embodiment shown, two detent receiving openings 64 are shown. The detent receiving openings 64 have engagement shoulders 66 which are provided proximate the side wall 24 of the box shaped contact portion 16.

In use, the contact 10 is inserted into a contact receiving cavity of contact receiving housing (not shown). If the contact 10 is not fully or properly inserted, the contact receiving cavity does not fully enclose or encapsulate the contact 10, allowing the contact 10, and in particular, the retention portion 32, to be engaged by a secondary lock or the like from the top or side. In previously known contacts, the force associated with such an engagement could result in the failure of the retention portion, as the top wall 28 and sloped side wall 30 could be easily moved or deformed. In contrast, the retention portion 32 of the present invention is strengthened to prevent damage or deformation without increasing the overall size of the terminal.

Referring to FIGS. 4 through 6, a force F1 applied to the top surface 28 of the retention portion 32 will cause the securing portion 52 of the back wall 50 to move further downward (as viewed in FIGS. 4 through 6) into cavity 54. As this occurs, the side wall 70 of the back wall 50 will engage either the side wall 22. Alternatively, as the force F1 is applied, a side wall 72 of the securing projection 52 will engage a side wall 74 of the cavity 54 formed in the top wall 20. In either case, the lateral movement the back wall 50 and the retention portion 32 relative to the box shaped contact portion 16 is prevented.

In addition, as the force F1 is applied to the top surface 28 of the retention portion 32, the engagement shoulders 62 of the detents 60 engage the engagement shoulders 66 of the detent receiving openings 64 to prevent the downward and the lateral movement the detents 60 and the retention portion 32 relative to the box shaped contact portion 16. In so doing, the retention portion 32 and the contact 10 are strengthened to prevent damage or deformation without increasing the overall size of the terminal.

Referring again to FIGS. 4 through 6, a force F2 applied to the side wall 22 will cause the securing portion 52 of the back wall 50 to engage the side wall 74 of the cavity 54 formed in the top wall 20 to prevent the lateral movement the back wall 50 and the retention portion 32 relative to the box shaped contact portion 16. In addition, the engagement shoulders 62 of the detents 60 engage the engagement shoulders 66 of the detent receiving openings 64 to prevent the downward and the lateral movement the detents 60 and the retention portion 32 relative to the box shaped contact portion 16. In so doing, the retention portion 32 and the contact 10 are strengthened to prevent damage or deformation without increasing the overall size of the terminal.

Referring again to FIGS. 4 through 6, a force F3 applied to the sloped side wall 30 will cause the side wall 70 of the back wall 50 to engage the side wall 22 to prevent the lateral movement the back wall 50 and the retention portion 32 relative to the box shaped contact portion 16. In so doing, the retention portion 32 and the contact 10 are strengthened to prevent damage or deformation without increasing the overall size of the terminal.

Figure 7:
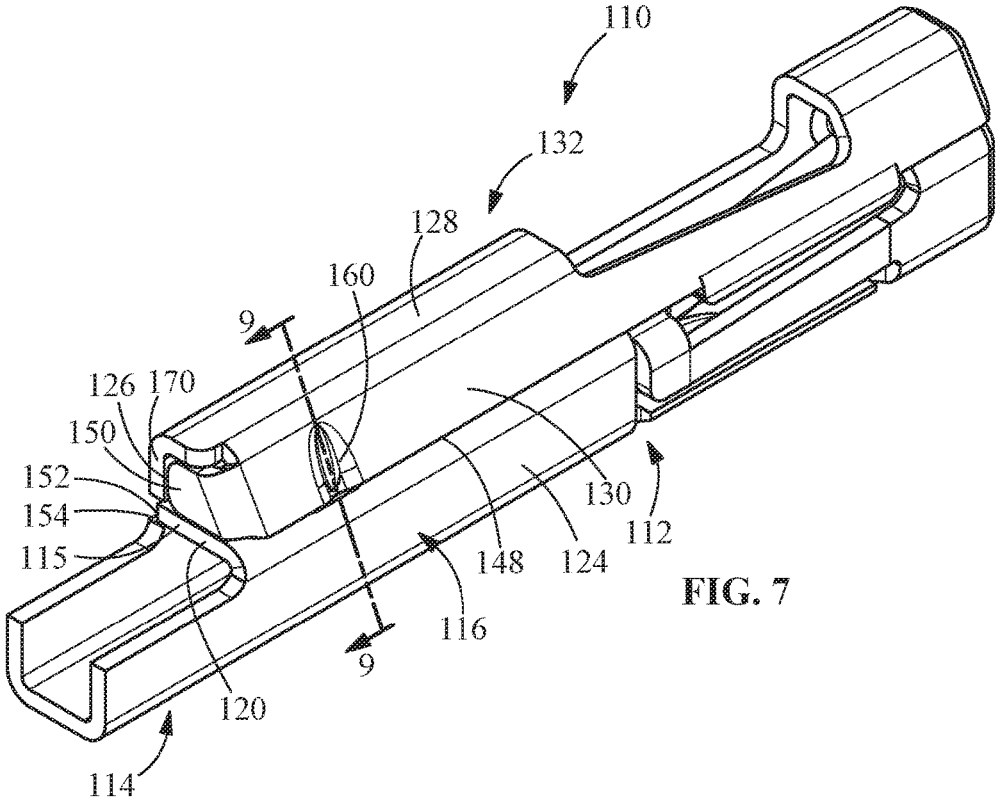
FIG. 7 is a back perspective view of a first alternate embodiment of an electrical terminal of the present invention.
Figure 8:
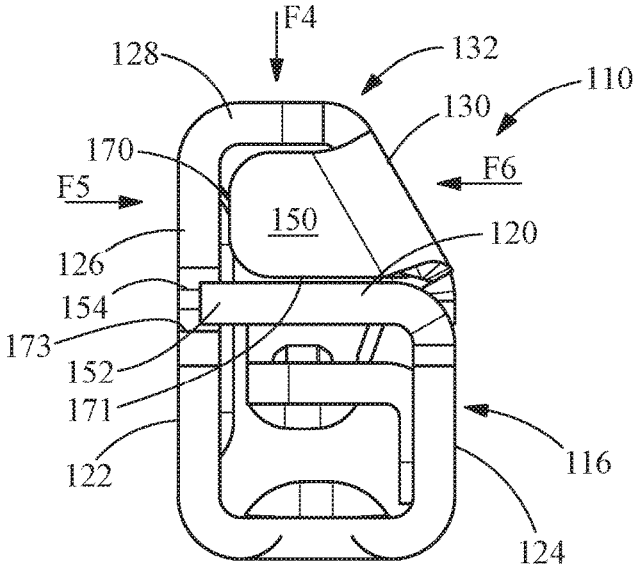
FIG. 8 is back view of the electrical terminal of FIG. 7.
Figure 9:
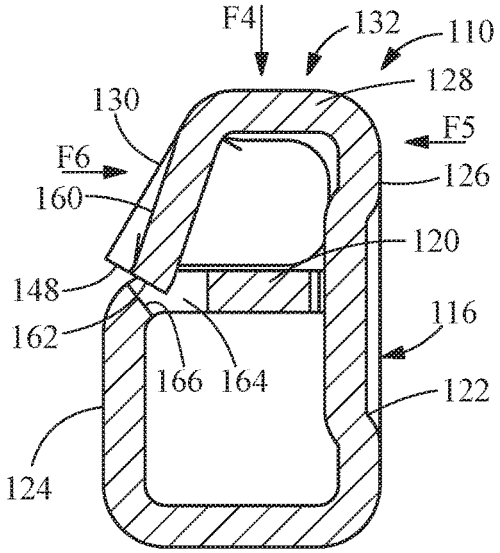
FIG. 9 is a cross-sectional view taken along line 9-9 of FIG. 7.

An alternate embodiment of the contact 110 is shown in FIGS. 7 through 9. The contact 110 is stamped from a single piece of material and is formed into the configuration shown in FIG. 7. In this embodiment, the contact 110 has a mating portion 112 and a transition portion or region 114. The contact 110, mating portion 112 and transition portion 114 are similar to that of contact 10, mating portion 12 and transition portion 14.

The retention portion 132 has a back wall 150 which extends from the sloped side wall 130. The back wall 150 extends at approximately 90 degrees from the sloped side wall 130. The back wall 150 is configured to approximate the space provided between the sloped side wall 130, the top wall 120 of the box shaped contact portion 116, the upper portion 126 of the side wall 122, and the top wall 128. As shown in FIG. 8, a securing tab 152 which is provided at the distal end of the top wall 120, extends into a cavity 154 formed in the side wall 122 proximate the back end 115. The cavity 154, as shown in FIGS. 7 and 8, is a cutout or opening which extends through the side wall 122 and which is dimensioned to receive and retain the securing tab 152 therein.

The retention portion 132 has a detent 160 provided on the sloped side wall 130. The detent 160 extends from the free end 148 of the sloped side wall 130. In the illustrative embodiment shown, one detent 160 is shown. However, other numbers and configurations of detents may be used. The detent 160 has an engagement shoulder 162 (FIG. 9) which is provided proximate the free end 148 of the sloped side wall 130.

As shown in FIG. 9, a detent receiving opening 164 is provided in the top wall 120 of the box shaped contact portion 116. The detent receiving opening 164 is positioned in alignment with the detent 160. In the illustrative embodiment shown, one detent receiving opening 164 is shown. The detent receiving opening 164 has an engagement shoulder 166 which is provided proximate the side wall 124 of the box shaped contact portion 116.

In use, the contact 110 is inserted into a contact receiving cavity of contact receiving housing (not shown). In In the contact 110 is not fully or properly inserted, the contact receiving cavity does not fully enclose or encapsulate the contact 1110, allowing the contact 110, and in particular, the retention portion 132, to be engaged by a secondary lock or the like from the top or side.

Referring to FIGS. 8 and 9, a force F4 applied to the top surface 128 of the retention portion 132 will cause a bottom wall 171 of the back wall 150 to engage the top wall 120. As the securing tab 152 of the top wall 120 is positioned in the cavity 154, the securing tab 152 engages a wall 173 of the cavity 154 to prevent the downward movement of the securing tab 152 and the top wall 120. As the top wall 120 is prevented from moving downward, the back wall 150 is also prevented from moving downward (as viewed in FIGS. 8 and 9).

As the force F4 is applied to the top surface 128 of the retention portion 132, the side wall 170 of the back wall 150 may also engage the side wall 122 to prevent the lateral movement the back wall 150 and the retention portion 132 relative to the box shaped contact portion 116. In addition, the engagement shoulder 162 of the detent 160 engage the engagement shoulder 166 of the detent receiving opening 164 to prevent the downward and the lateral movement the detent 160 and the retention portion 132 relative to the box shaped contact portion 116. In so doing, the retention portion 132 and the contact 110 are strengthened to prevent damage or deformation without increasing the overall size of the terminal.

Referring again to FIGS. 8 and 9, a force F5 applied to the side wall 122 will cause the engagement shoulder 162 of the detent 160 to engage the engagement shoulder 166 of the detent receiving opening 164 to prevent the downward and the lateral movement the detent 160 and the retention portion 132 relative to the box shaped contact portion 116. In so doing, the retention portion 132 and the contact 110 are strengthened to prevent damage or deformation without increasing the overall size of the terminal.

Referring again to FIGS. 8 and 9, a force F6 applied to the sloped side wall 130 will cause the side wall 170 of the back wall 150 to engage the side wall 122 to prevent the lateral movement the back wall 150 and the retention portion 132 relative to the box shaped contact portion 116. In so doing, the retention portion 132 and the contact 110 are strengthened to prevent damage or deformation without increasing the overall size of the terminal.

The contact 10, 110 has improved strength to prevent damage or deformation. The contact 10, 110 provide the increased strength and stability without increasing the overall size of the terminal, thereby allowing the contact to be used for miniature contacts.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical contact comprising:

a mating portion for mating with a mating contact, the mating portion having a contact portion and a retention portion;

the mating portion having a mating portion bottom wall, a mating portion top wall and mating portion side walls, a respective mating portion side wall having an upper portion which extends beyond the top wall, the upper portion extends to form the retention portion;

the retention portion having a retention portion top wall, a retention portion side wall and a retention portion back wall, the retention portion back wall is configured to approximate the space provided between the mating portion top wall, the upper portion of the respective mating portion side wall, the retention portion top wall and a retention portion side wall, the retention portion has an opening which extends through the mating portion top wall and the mating portion side wall;

wherein the retention portion back wall cooperates with one or more of the mating portion top wall, the upper portion of the respective mating portion side wall, the retention portion top wall and a retention portion side wall to prevent damage or deformation of the retention portion as a force applied to the retention portion.

2. The electrical contact as recited in claim 1, wherein the retention portion side wall is sloped relative to the retention portion top wall and the mating portion top wall.

3. The electrical contact as recited in claim 2, wherein a free end of the sloped retention portion side wall is positioned proximate the mating portion top wall.

4. The electrical contact as recited in claim 3, wherein the retention portion back wall extends from the sloped retention portion side wall at approximately 90 degrees from the sloped retention portion side wall.

5. The electrical contact as recited in claim 1, wherein a detent is provided on the retention portion side wall, the detent extends from a free end of the retention portion side wall.

6. The electrical contact as recited in claim 5, wherein the detent has an engagement shoulder provided proximate the free end of the retention portion side wall.

7. The electrical contact as recited in claim 6, wherein a detent receiving opening is provided on the mating portion top wall, the detent receiving opening positioned in alignment with the detent.

8. The electrical contact as recited in claim 7, wherein the detent receiving opening has and engagement shoulder which is provided proximate the mating portion side wall.

9. The electrical contact as recited in claim 1, wherein a securing portion extends from the retention portion back wall, the securing portion extends into a cavity formed in the mating portion top wall.

10. The electrical contact as recited in claim 1, wherein the mating portion has a first resilient contact projection and a second resilient contact projection, which are formed integrally from the mating portion bottom wall and the mating portion top wall, respectively.

11. The electrical contact as recited in claim 10, wherein the resilient contact projections have movable contact areas, the contact areas are rounded and are laterally offset.

12. The electrical contact as recited in claim 11, wherein an overstress protection portion extends from the mating portion side wall to cooperate to prevent the overstress of a respective contact projection.

13. An electrical contact comprising:

a mating portion for mating with a mating contact, the mating portion having a contact portion and a retention portion;

the mating portion having a mating portion bottom wall, a mating portion top wall and mating portion side walls, a respective mating portion side wall having an upper portion which extends beyond the top wall, the upper portion extends to form the retention portion, a detent receiving opening is provided on the mating portion top wall;

the retention portion having a retention portion top wall and a retention portion side wall;

a detent is provided on the retention portion side wall, the detent extends from a free end of the retention portion side wall, the detent positioned in alignment with the detent receiving opening;

wherein the detent cooperates with the detent receiving opening to prevent damage or deformation of the retention portion as a force applied to the retention portion.

14. The electrical contact as recited in claim 13, wherein the retention portion has a retention portion back wall provided between the mating portion top wall, the upper portion of the respective mating portion side wall, the retention portion top wall and a retention portion side wall, wherein the retention portion back wall cooperates with one or more of the mating portion top wall, the upper portion of the respective mating portion side wall, the retention portion top wall and the retention portion side wall.

15. The electrical contact as recited in claim 13, wherein the retention portion side wall is sloped relative to the retention portion top wall and the mating portion to wall.

16. The electrical contact as recited in claim 14, wherein a free end of the sloped retention portion side wall is positioned proximate the mating portion top wall.

17. The electrical contact as recited in claim 15, wherein the detent has an engagement shoulder provided proximate the free end of the retention portion side wall.

18. The electrical contact as recited in claim 16, wherein the detent receiving opening has an engagement shoulder which is provided proximate the mating portion side wall.

19. The electrical contact as recited in claim 17, wherein a securing portion extends from the retention portion back wall, the securing portion extends into a cavity formed in the mating portion top wall.

20. The electrical contact as recited in claim 18, wherein the retention portion has an opening which extends through the mating portion top wall and the mating portion side wall, the opening is dimensioned to receive a locking projection of a connector housing into which the contact is inserted.

* * * * *